United States Patent [19]

Powell et al.

[11] 4,042,896

[45] Aug. 16, 1977

[54] MANUAL AND MOTOR OPERATED CIRCUIT BREAKER

[75] Inventors: David B. Powell, Burlington; Roger N. Castonguay, Terryville; Donald F. Aitken, Plainville, all of Conn.

[73] Assignee: General Electric Company, New York, N.Y.

[21] Appl. No.: 672,728

[22] Filed: Apr. 1, 1976

[51] Int. Cl.[2] ..... H01H 73/12

[52] U.S. Cl. ..... 335/17; 335/74; 335/173

[58] Field of Search ..... 335/17, 68, 74, 76, 335/169, 170, 173

[56] References Cited

U.S. PATENT DOCUMENTS

| | | | |
|---|---|---|---|
| 3,213,236 | 10/1965 | Pendy et al. | 335/74 |
| 3,371,296 | 2/1968 | Salvati et al. | 335/74 |
| 3,559,121 | 1/1971 | Powell et al. | 335/68 |
| 3,652,815 | 3/1972 | Davies | 335/76 |
| 3,806,684 | 4/1974 | Hauser | 335/76 X |

*Primary Examiner*—George Harris

*Attorney, Agent, or Firm*—Robert A. Cahill; Walter C. Bernkopf; Frank L. Neuhauser

[57] ABSTRACT

A circuit breaker is equipped with both a rotary operating handle and a power unit for selective manual and motor driven operation thereof. Mechanical and electrical control elements cooperate to insure a reliable operation in both the manual and motor driven operating modes, and, as a safety measure, to provide fool-proof, visual indications of the circuit breaker condition during the progressive stages of either operating mode. The power unit utilizes a permanent magnet, DC motor for improved performance and economies in design.

27 Claims, 21 Drawing Figures

MANUAL AND MOTOR OPERATED CIRCUIT BREAKER

BACKGROUND OF THE INVENTION

The present invention relates to circuit breakers of the industrial type which are equipped with motor operators to afford the capability of operating the circuit breakers from a remote control center either manually upon actuation of a control switch or automatically in coordination with the operations of other circuit breakers. Motor operated industrial circuit breakers thus have particular application as, for example, process control switches of high current carrying capacity and have the inherent benefit of also providing automatic overload and short circuit protection. The typical industrial circuit breaker of the molded case variety utilizes a spring powered operating mechanism for articulating its movable contacts into and out of engaging relation with its fixed contacts. The motor operator is thus utilized to charge the breaker operating mechanism spring, and once charged, the energy stored therein is released to abruptly drive the breaker movable contacts to their closed position. Illustrative of prior art motor operated circuit breakers of this character is the disclosure in the commonly assigned U.S. Pat. No. 3,559,121.

It is accordingly a general object of the present invention to provide an improved motor operated, industrial molded case circuit breaker.

An additional object is to provide a circuit breaker of the above character, wherein the motor operator is compact and economical in design, and reliable in operation.

Yet another object of the invention is to provide a circuit breaker of the above character which is selectively operable either by the motor operator or manually, as desired.

A further object is to provide a circuit breaker of the above character which is equipped with indicating means for reliably identifying the breaker condition.

Other objects of the invention will in part be obvious and in part appear hereinafter.

SUMMARY OF THE INVENTION

In accordance with the present invention, there is provided a circuit breaker which is adapted for either manual or motor driven operation, as desired. Motor driven operation is achieved by the incorporation of a power unit comprising a motor selectively drivingly coupled to the circuit breaker operating mechanism and operating to charge the mechanism spring incident to closing the breaker contacts. Upon completion of a charging function, a closing solenoid is energized to effect release of the stored energy, which powers the breaker contacts to their closed position. Control elements sensitive to the condition of the operating mechanism and the position of the breaker movable contacts function to appropriately condition switching logic in the motor and closing solenoid circuit for sequencing the charging and closing functions in a reliable manner. The control elements further funtion to selectively position indicator means effective to visually identify the various breaker conditions.

Manual operation of the circuit breaker is effected in the same manner, except that the motor is decoupled from the breaker operating mechanism and a manual operating handle is coupled thereto for charging the mechanism spring. An interlock switch disables the motor circuit during a manual charging function. The control elements function as in the powered charging function to appropriately position the indicator means. Once the operating mechanism is charged manually, contact closure can be effected via the closing solenoid or by manipulation of a button to release the stored energy.

As an important feature of the present invention, the motor is a permanent magnet D.C. motor which offers the distinct advantage of being readily susceptible to precise dynamic braking. As a consequence, a motor of this type can be abruptly braked to a stop at the conclusion of a charging function with the power unit parts in their appropriate starting positions poised for a subsequent charging function.

The invention accordingly comprises the features of construction, combination of elements, and arrangement of parts which will be exemplified in the detailed description hereinafter set forth, and the scope of the invention will be indicated in the claims.

For a fuller understanding of the nature and objects of the invention, reference should be had to the following detailed description taken in connection with the accompanying drawings, in which.

Figure 1:
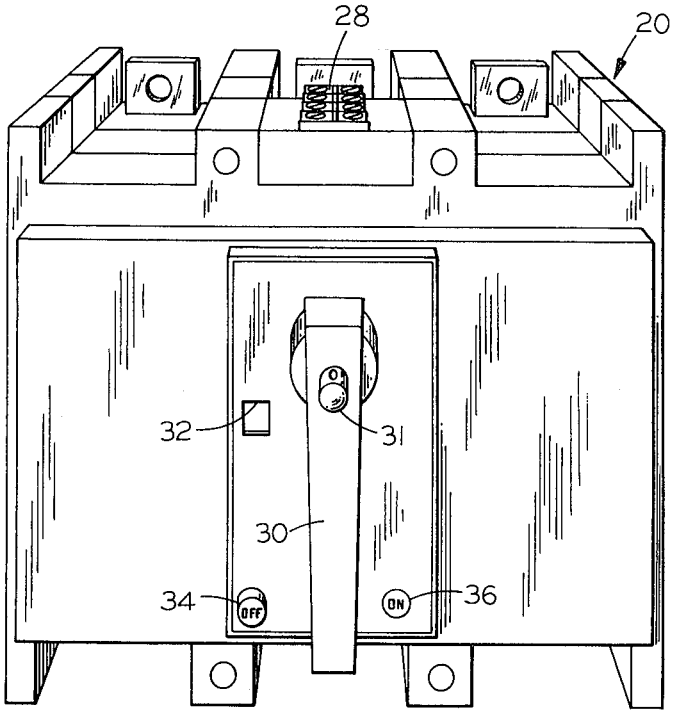
FIG. 1 is an isometric view of a circuit breaker constructed according to an embodiment of the present invention.
Figure 20:
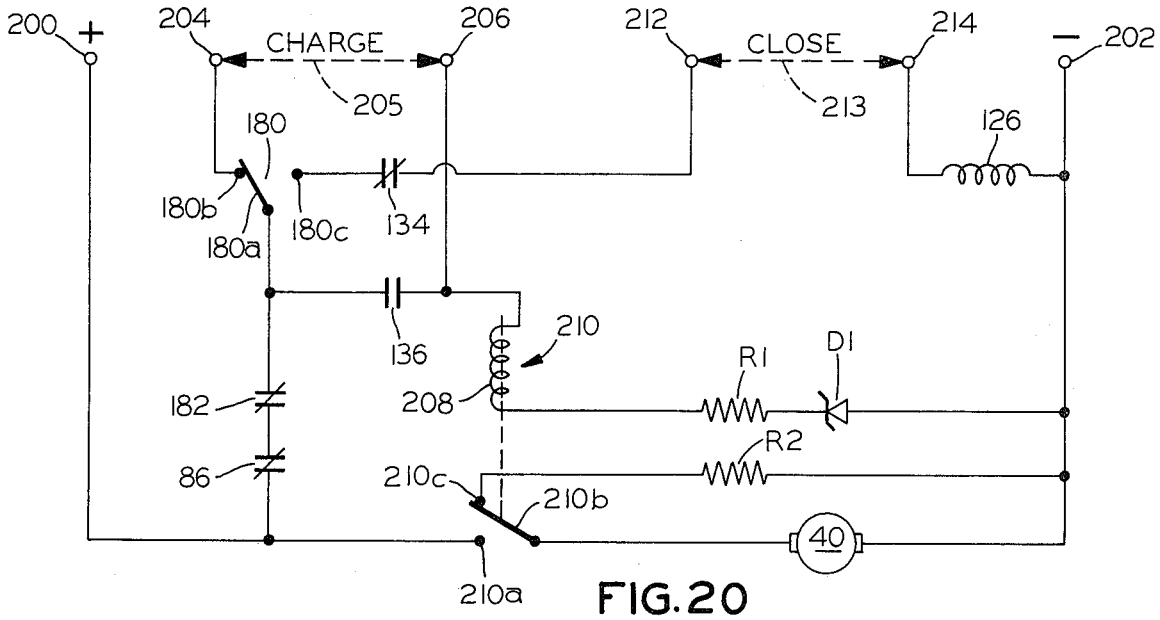
Figures 15, 21:
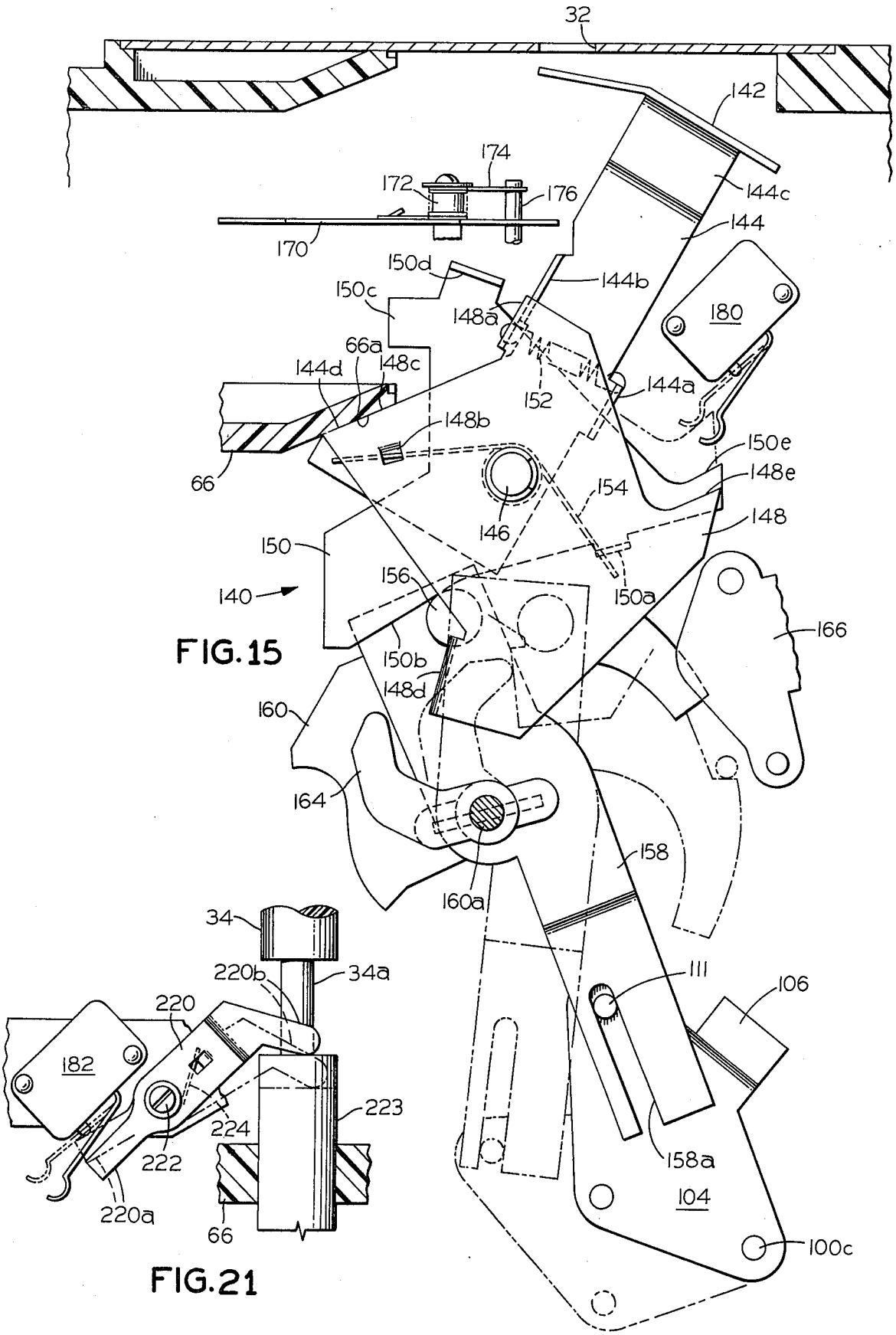
Figure 16:
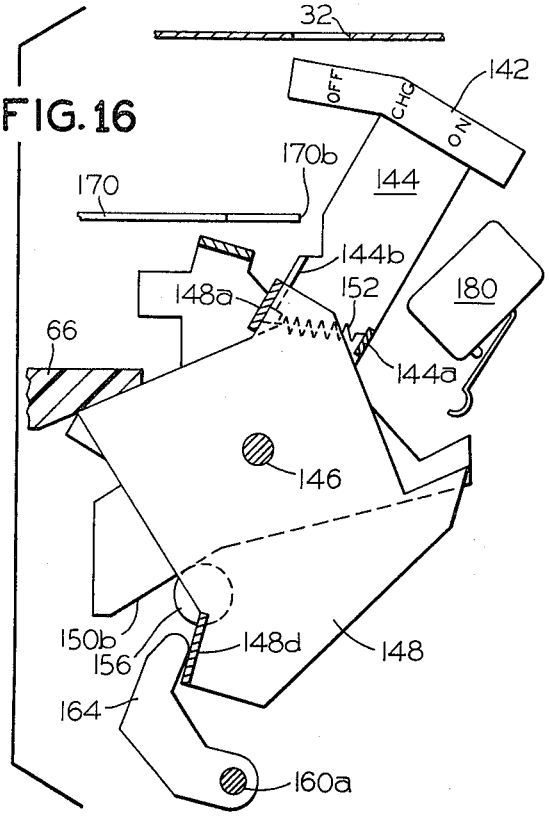
Figure 17:
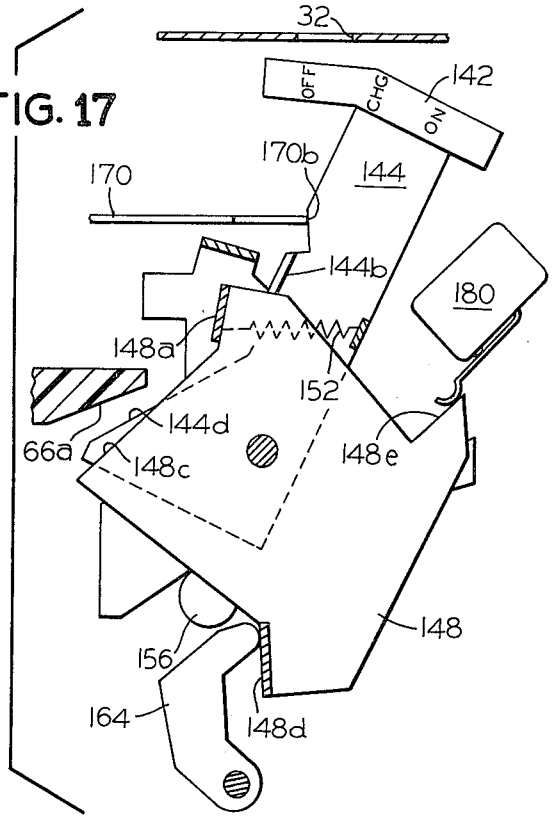

FIG. 15 is a side elevational view of an indicator mechanism operating to sense the various positions of breaker operating mechanism parts and operating accordingly to control an indicator display and the conditions of various switches utilized in the power unit electrical control circuitry;

FIGS. 16 through 19 are a series of fragmentary side elevational views illustrating the positions of the various parts seen in FIG. 15 at various points in the breaker charging and closing cycles;

FIG. 20 is a schematic diagram of the electrical control circuit for the power unit; and FIG. 21 is a fragmentary, side elevational view of an anti-pumping mechanism incorporated in the circuit breaker of FIG. 1.

Corresponding reference numerals refer to like parts throughout the several views of the drawings.

DETAILED DESCRIPTION

Figure 2:
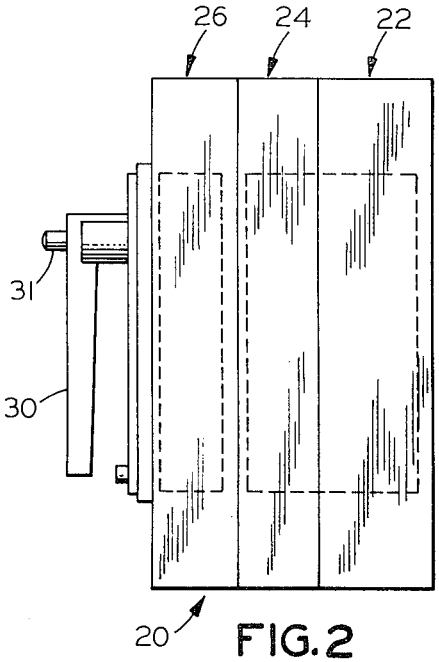
FIG. 2 is a side elevational view of the circuit breaker of FIG. 1.

Referring to FIGS. 1 and 2, the circuit breaker of the present invention, generally indicated at 20, consists of three subassemblies, namely, a circuit breaker assembly 22, a power unit assembly 24, and a cover assembly 26, all secured together in stacked relation. The circuit breaker assembly 22 includes the basic operating components of a circuit breaker which preferably is of the construction shown in the commonly assigned Jencks and Castonguay patent application, Ser. No. 627,149, filed Oct. 30, 1975. The disclosure of this co-pending application is specifically incorporated herein by reference. The power unit assembly 24 includes a motor operator, to be described below, for providing powered operation of the circuit breaker assembly 22 from is open circuit or OFF condition to its closed circuit or ON condition. A terminal strip 28, mounted to the circuit breaker 20, facilitates electrical connection to a control device (not shown) for the purpose of affording remote operation of the circuit breaker by way of the power unit assembly 24. The cover assembly 26 includes an operating handle 30 which may be used to operate the circuit breaker 20 manually instead of via power unit 24. As will be seen, to effectuate the operating handle 30 for manual circuit breaker operation, a button 31 is depressed to disengage the power unit 24 from circuit breaker assembly 22 and engage the handle with the circuit breaker operating mechanism. The cover assembly also includes a window 32 through which a position indicator, to be described, is visible to identify whether the contacts of the circuit breaker assembly 22 are open or closed and when the circuit breaker operating mechanism is charged preparatory to contact closure. Manual controls for operating the circuit breaker include an OFF button 34 and an ON button 36. The OFF button is depressed to trip the circuit breaker assembly 22 from its ON condition to its OFF condition, while the ON button is depressed to turn the circuit breaker ON once the breaker operating mechanism is charged either via the power unit assembly 24 or the manual handle 30.

Figure 3:
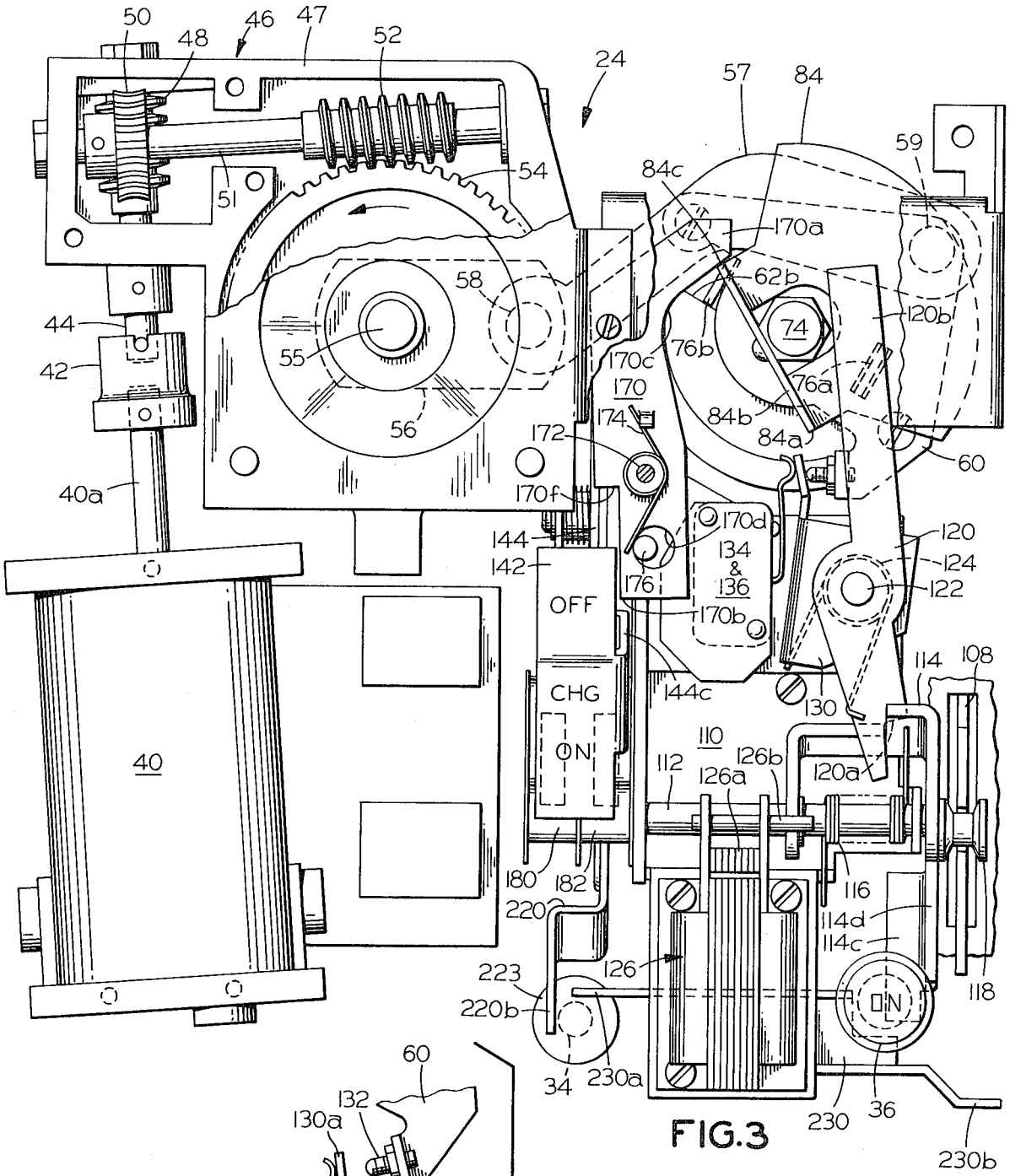
FIG. 3 is a plan view, partially broken away, of a power unit incorporated in the circuit breaker of FIG. 1.
Figure 5:
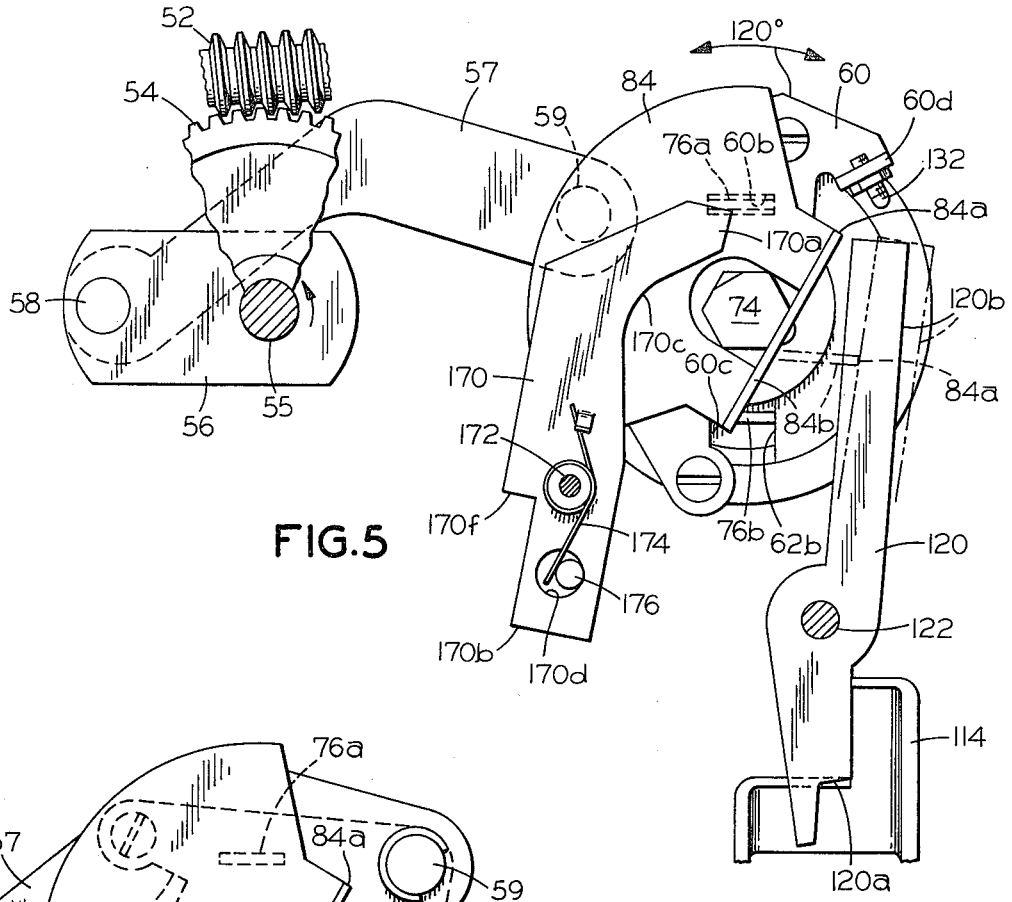
FIG. 5 is a framentary plan view of a portion of the power unit of FIG. 3 depicting the positions of various parts substantially at the midpoint of a powered breaker mechanism charging cycle.
Figure 4:
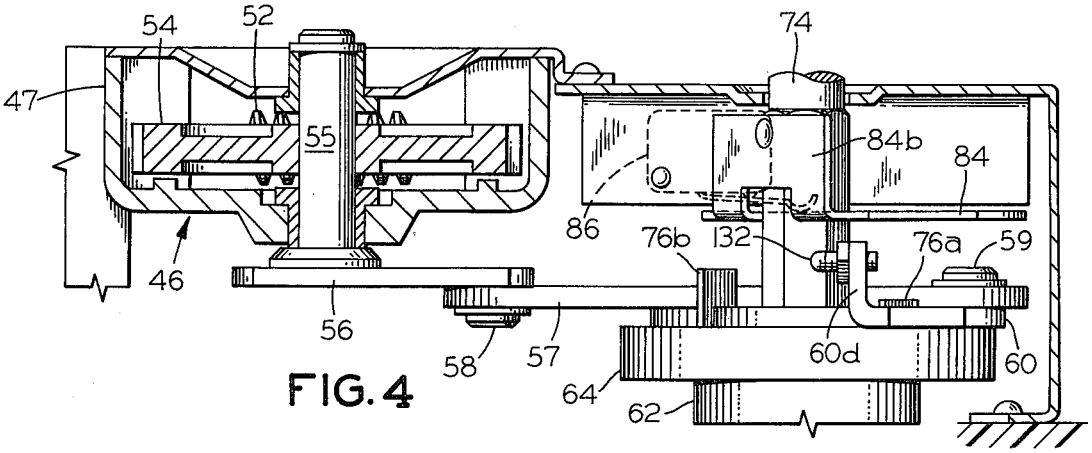
FIG. 4 is a side elevational view, partially in section, depicting the drive portion of the power unit of FIG. 3.

The power unit assembly 24, best seen in FIG. 3, includes an electric motor 40 which, according to one feature of the invention, is a permanent magnet, D.C. motor. The output shaft 40*a* of this motor is drivingly connected via a coupling 42 to the input shaft 44 of a gear box, generally indicated at 46. Input shaft 44, journaled by the gear box housing 47, carries a worm 48 which engages a worm gear 50 mounted on a shaft 51, also journaled by the gear box housing. Shaft 51 also carries a worm 52 which engages a worm gear 54 mounted on an output shaft 55 journaled by the gear box housing 47. As best seen in FIG. 4, a crank arm 56 is keyed to the lower end portion of output shaft 55 protruding through the underside of gear box housing 47. An elongated link 57 is pivotally connected at one end by a pin 58 to the free end of crank arm 56 and is pivotally connected at its other end by a pin 59 to a drive plate 60 (FIGS. 3–5). Comparing FIGS. 3 and 5, it is seen that for each full rotation in the counterclockwise direction of gear box output shaft 55, drive plate 60 is first rotated approximately 120° in the counterclockwise direction and then rotated back in the clockwise direction 120° to its initial, home position. As will be seen, motor 40 is energized to drive the gear box output shaft through a full turn in the counterclockwise direction to oscillate drive plate 60 through a 120° arc pursuant to charging the operating mechanism within the circuit breaker assembly 22.

Figure 9:
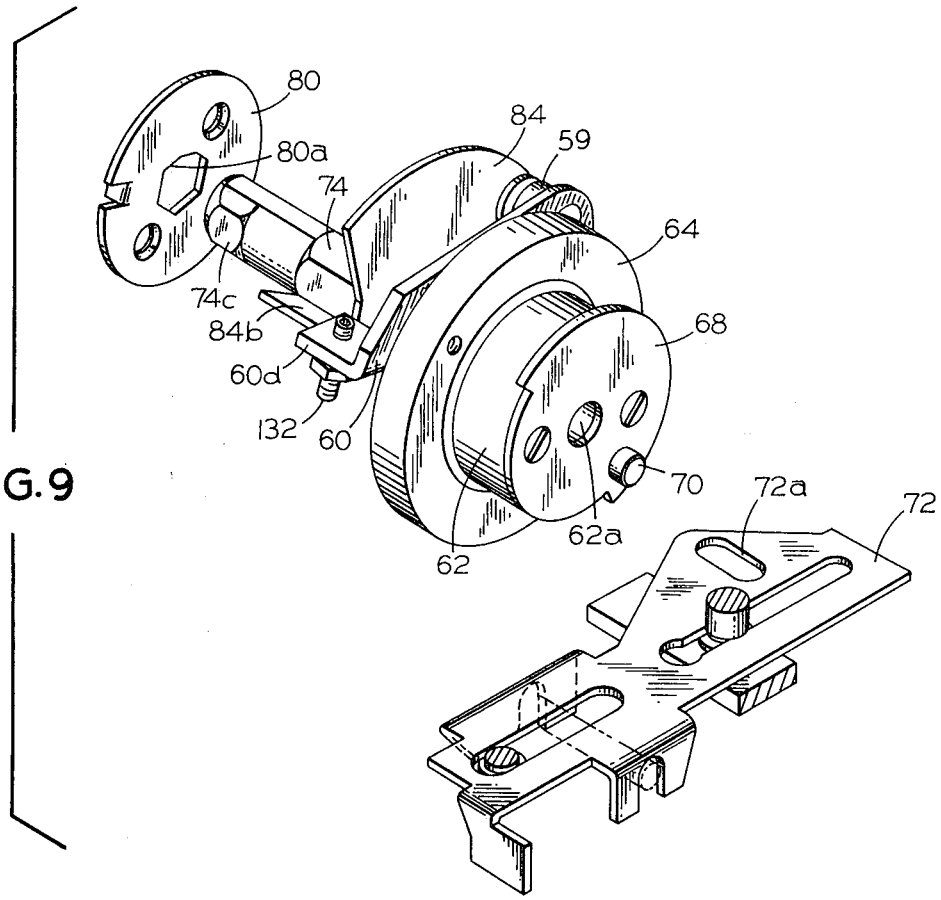
FIG. 9 is an exploded perspective view illustrating the manner of coupling the parts depicted in FIGS. 7 and 8 to the breaker operating mechanism.
Figure 7:
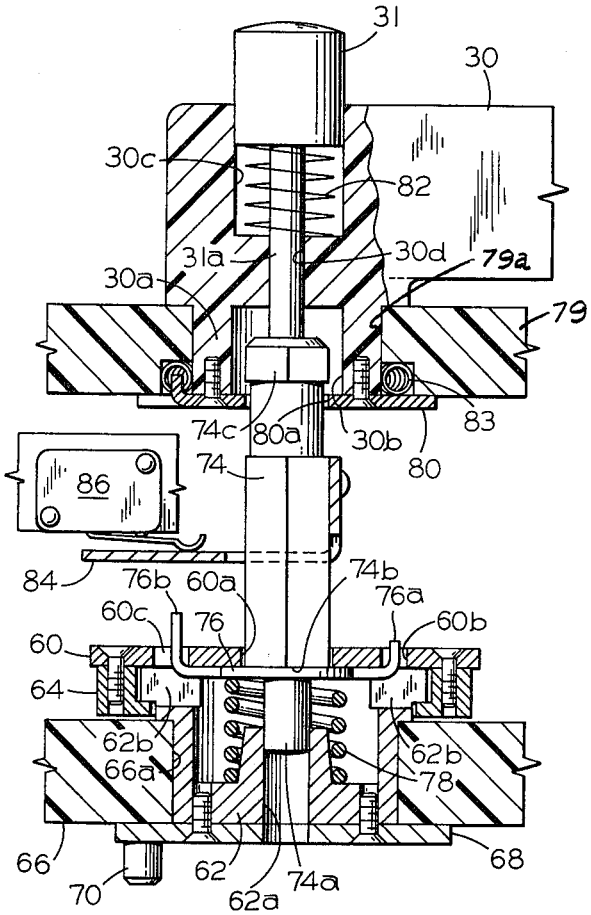
FIG. 7 is a vertical sectional view of a portion of the power unit of FIG. 3 illustrating the positions of the parts assumed for powered charging of the breaker operating mechanism.
Figure 8:
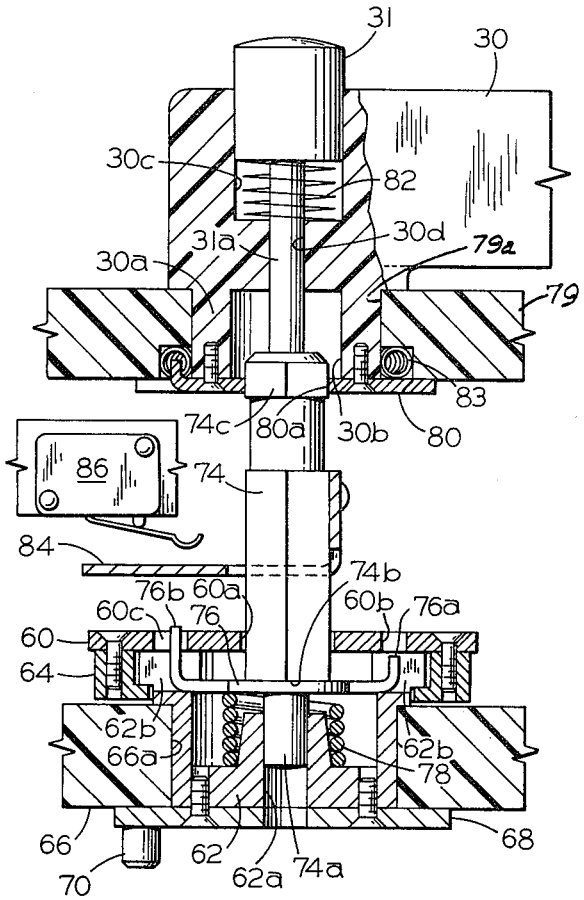
FIG. 8 is a vertical sectional view of the same portion of the power unit depicted in FIG. 7, with the various parts positioned to accommodate manual charging of the breaker operating mechanism.

Turning to FIGS. 7 through 9, drive plate 60 sits atop a hub 62 and is secured for rotation relative thereto by a collar 64. The hub is mounted for rotation in an opening 66*a* in the floor 66 of the power unit assembly housing. This rotatable hub is captured in floor opening 66*a* by a second drive plate 68 fastened to its lower butt end. As best seen in FIG. 9, the second drive plate 68 carries a depending pin 70 which operates in a laterally elongated slot 72*a* formed in a circuit breaker operating mechanism slide 72. This operating slide, which corresponds to the operating slide disclosed in the above-noted co-pending application, is reciprocated fore and aft to charge the breaker mechanism preparatory to closure of the breaker contacts.

Figure 6:
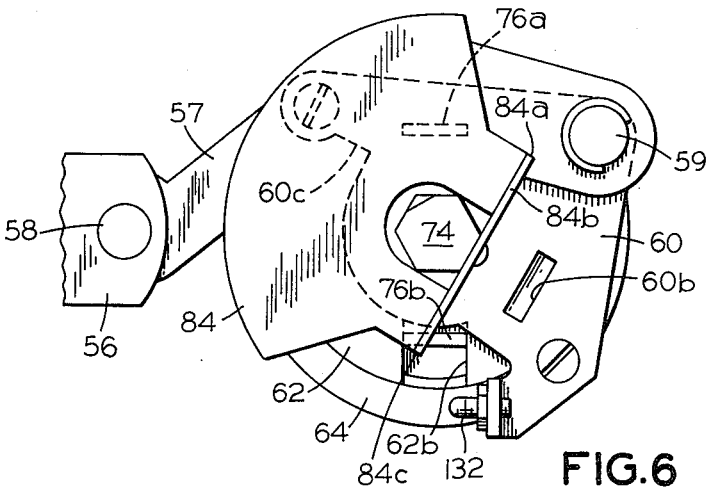
FIG. 6 is a fragmentary plan view of a portion of the power unit of FIG. 3 showing the positions of the various parts substantially at the midpoint of a manual charging cycle.

As best seen in FIGS. 7 and 8, drive plate 60 is provided with a central clearance opening 60*a* through which is received a vertical operating shaft 74. The lower terminal portion 74*a* of this shaft is journalled in a central bore 62*a* formed in hub 62. Drive plate 60 is, in turn, selectively drivingly connected to shaft 74 by a coupling element 76 affixed to the shouldered portion 74*b* of the shaft located below the drive plate. This coupling element is formed having an upwardly extending one end, providing short tab 76*a* which is normally received in a slot 60*b* in drive plate 60 (FIG. 7). The other end of coupling element 76 carries a longer, upturned tab 76*b* which is engaged for counterclockwise rotation by a shoulder 60*c* formed in drive plate 60, as best seen in FIGS. 3, 5 and 6. A compression spring 78, incorporated in hub 62, acts against the underside of drive coupling 76 to normally bias shaft 74 to an elevated position such that coupling member tab 76*a* is engaged in drive plate slot 60*b* (FIG. 7). Under these circumstances, it is seen that counterclockwise rotation of drive plate 60 via motor 40 and gear box 46 is communicated to operating shaft 74 by way of coupling element 76. That is, coupling element tab 76*a* is engaged in the closed ended slot 60*b*, while its tab 76*b* is engaged by shoulder 60*c* of the drive plate to communicate counterclockwise rotation of the drive plate to the operating shaft. At the conclusion of the 120° C counterclockwise rotation of the drive plate, its return to home position in the clockwise direction induces clockwise rotation of the operating shaft by virtue of the engagement of coupling element tab 76*a* in drive plate slot 60*b*. Coupling element tabs 76*a* are accommodated in diametrically opposed slots 62*b* (FIGS. 3 and 5–8) formed in the upper portion of hub 62, such that, regardless of vertical position, clockwise and counterclockwise rotation of operating shaft 74 is faithfully coupled to the hub, and the operating slide 72 (FIG. 9) is thus reciprocated fore and aft to charge the circuit breaker operating mechanism.

Continuing with reference to FIGS. 7 and 8, manual operating handle 30 includes a hub portion 30*a* which is received in a clearance opening 79*a* provided in the front wall 79 of the cover assembly housing. The manual operating handle is captured in place by a drive plate 80 secured to the butt end of handle hub 30*a*. The upper terminal portion 74*c* of operating shaft 74 projects through a hex-shaped central opening 80*a* in drive plate 80 (FIG. 9) to be normally accommodated in a central recess 30*b* formed in handle hub 30*a*. Button 31 is received in a cavity 30*c* formed in handle 30 and includes a stem 31*a* which extends through a bore 30*d* into hub recess 30*b* for abutting engagement with the upper end of operating shaft 74. A compression spring 82 disposed in handle cavity 30*c* normally biases button 31 to its elevated position.

To effectuate the handle 30 for manual operation of the circuit breaker operating mechanism, button 31 is depressed, as seen in FIG. 8, to shift operating shaft 74 bodily downward to a depressed position such as to position its upper terminal portion 74*c*, which is hex-shaped, in rotatably driven engagement with drive plate 80. With shaft 74 in this depressed position, coupling element tab 76*a* drops out of drive plate slot 60*b* to thus decouple the drive plate 60 from the shaft during counterclockwise rotation of the latter by manual operating handle 30. It will also be noted that once coupling element tab 76*a* moves out of registry with drive plate slot 60*b*, the upper end of this tab bears against the underside of the drive plate (FIG. 6) to maintain the shaft 74 in its depressed position against the bias of compression spring 78 for the major portion of the cranking movement of the rotary operating handle 30 in charging the breaker operating mechanism. Since coupling element tab 76*b* has a greater vertical extent that tab 76*a*, depression of the operating shaft 74 does not drop this tab below the level of drive plate 60. However, during counterclockwise rotation of shaft 74, this tab 76*b* simply swings away from the stationary drive plate shoulder 60*b* (FIG. 6). The vertical elongation of tab 76*b* is utilized at the conclusion of the return, clockwise rotation of the operating handle 30, since this tab swings back into engagement with drive plate shoulder 60*b* to establish the home positions for both the shaft and handle. Upon arrival at their home positions, coupling element tab 76*a* moves into registry with drive plate slot 60*b*, and compression spring 78 then becomes efective to bodily shift shaft 74 to its elevated position and automatically decouple operating handle 30. A handle return spring 83 serves to insure that the handle fully returns to its home position.

A pre-shaped plate 84, seen in FIGS. 3–9, is affixed to operating shaft 74 and is angularly positioned to maintain depressed the actuator of a switch 86 throughout the entire 120° rotational movement of the operating shaft 74 while in its elevated position. As will be seen from FIG. 20, switch 86 is included in the control circuit for power unit assembly 24 to enable the control circuit as long as its actuator is depressed by plate 84 (FIG. 7). However, when shaft 74 is depressed to decouple power unit drive plate 60 and, in turn, couple the manual operating handle 30 to the shaft, plate 84 releases switch 86 (FIG. 8), and its contacts open to completely disable the control circuit.

Figure 10:
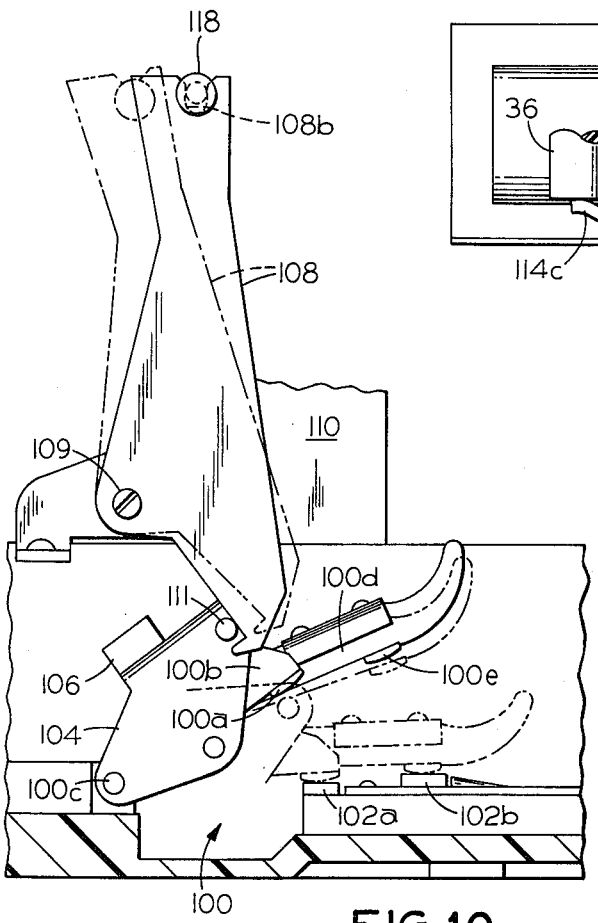
FIG. 10 is a fragmentary side elevational view illustrating the operation of a hook in latching the breaker movable contacts in their open circuit positions during a breaker mechanism charging cycle.

As seen in FIG. 10, the circuit breaker assembly 22 includes for each breaker pole a movable contact assembly, generally indicated at 100, consisting of plural movable main contacts 100*a* individually mounted at the ends of contact arms 100*b* which are, in turn, pivotally mounted at their other ends to a hinge pin 100*c*. An elongated arm 100*d*, also hinged to pin 100*c*, carries a movable arcing contact 100*e*. The movable main contacts 100*a* and the movable arcing contact 100*e* engage stationary main contacts 120*a* and a stationary arcing contact 102*b* when the contact assembly is pivoted to a closed circuit position shown in phantom. Each movable contact assembly includes a U-shaped bracket 104, also hinged on 100*c*, for coupling the contact arms 100*b* and 100*d* together for movement in unison between open circuit and closed circuit positions. The brackets 104 of the plural contact assemblies 100 are ganged together by a crossbar 106, such that the contact arms in all breaker poles move in concert.

Figure 11:
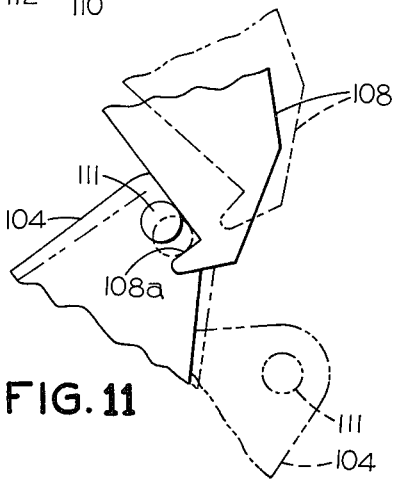
FIG. 11 is an enlarged, fragmentary elevational view of a portion of FIG. 10.

An elongated hook 108, seen in FIG. 10, is pivotally mounted intermediate its ends by a screw 109 secured to a bracket 110. The lower end of this hook carries a latch shoulder 108*a* for latching engagement with a pin 111 mounted by one of the contact assemblies 100 while in its open circuit, solid line position (FIG. 11). As will be seen, hook 108 is utilized to latch the movable contact assemblies in their open circuit position while the breaker operating mechanism is being charged either by the power unit 24 or rotary operating handle 30. Once the breaker operating mechanism is fully charged, hook 108 is pivoted to its broken line position, thereby disengaging latch shoulder 108*a* from pin 111 and the energy stored in the breaker operating mechanism is thus released to abruptly pivot the movable contact assemblies to their closed circuit position.

Figure 12:
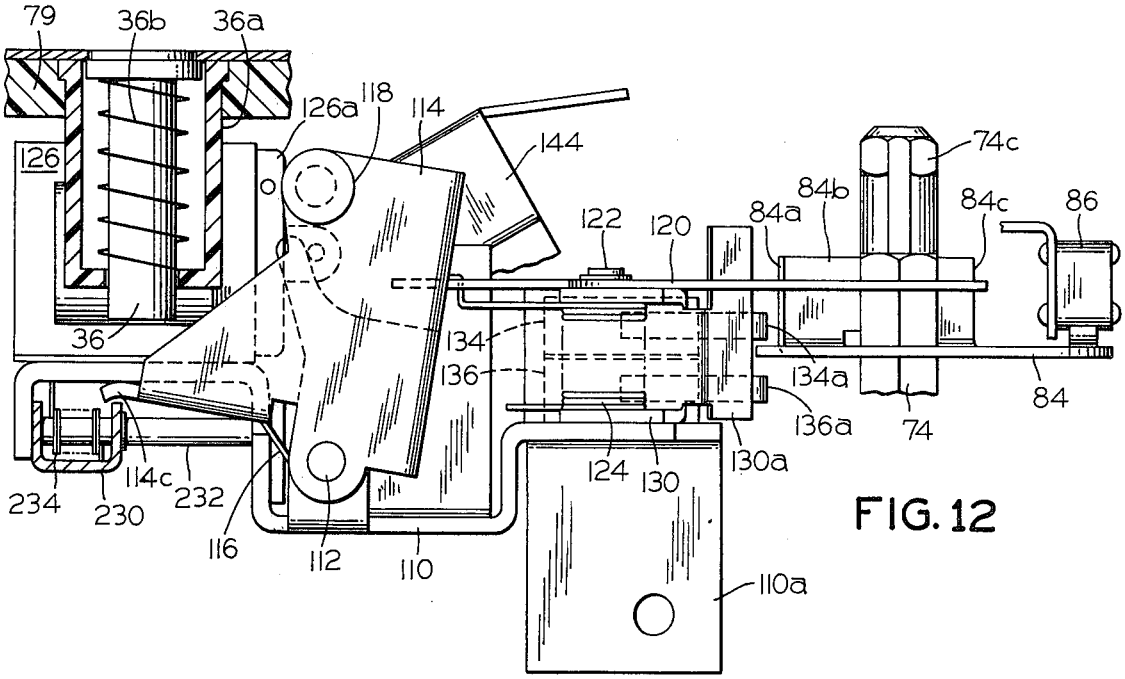
FIG. 12 is a side elevational view of a circuit breaker closing mechanism for articulating the hook of FIG. 10.

As seen in FIGS. 3 and 12, bracket 110 mounts an elongated, horizontally oriented pin 112 which serves to pivotally mount a U-shaped closing lever 114. A torsion spring 116, carried on pin 112, acts against bracket 110 to bias lever 114 for pivotal movement in the clockwise direction seen in FIG. 12. A roller 118 mounted adjacent the upper end of the closing lever operates in a notch 108*b* (FIG. 10) formed in the upper end of hook 108. Closing lever 114 is held in its cocked, counterclockwise most position of FIG. 12 against the urgence of its torsion spring 116 by a latch lever 120, best seen in FIG. 3. This latch lever is pivotally mounted intermediate its ends on a pin 122 supported by bracket 110. A torsion spring 124 urges the latch lever in the counterclockwise direction so as to position a shoulder 120*a* carried adjacent one end in latching engagement with closing lever 114, thus maintaining the latter in its cocked position.

From FIG. 10, it is seen that with the closing lever in its cocked position, hook 108 assumes its phantom position with its latch shoulder 108*d* removed from engagement with pin 111 carried by one of the contact assemblies 100. Upon initial rotation of the operating shaft 74 pursuant to charging the circuit breaker operating mechanism via either power unit 24 or rotary operating handle 30, the leading edge 84*a* of an upturned mounting flange 84*b* by which plate 84 is secured to the operating shaft, engages the other end 120*b* of latch lever 120 to pivot the latch lever in the clockwise direction (FIG. 5), thereby releasing closing lever 114 from its cocked position. This closing lever thus pivots in the clockwise direction from the position seen in FIG. 12 to the position shown in FIG. 13 and hook 108 is pivoted to its solid line position seen in FIG. 10, bringing its shoulder 108*a* into latching engagement with pin 111 of the contact assembly 100. The movable contacts are thus held by hook 108 in their open circuit positions while the breaker operating mechanism is being charged.

Figure 13:
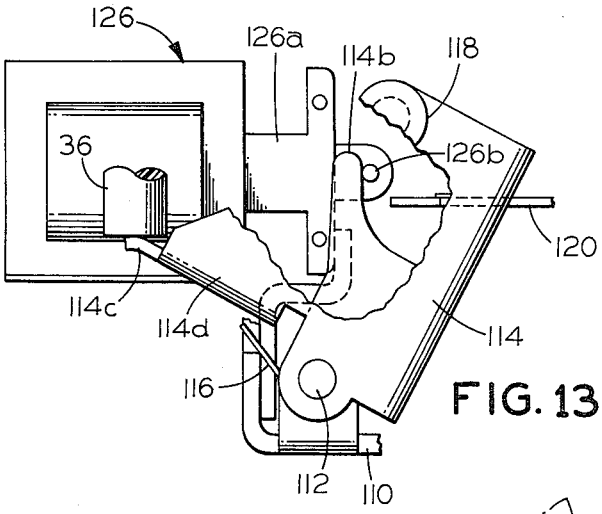
FIG. 13 is a fragmentary side elevational view showing the parts of the closing mechanism of FIG. 12 in their armed positions assumed at the conclusion of a breaker mechanism charging cycle.

Once the breaker operating mechanism is fully charged, hook 108 is pivoted back to its broken line position of FIG. 10 by either a closing solenoid, generally indicated at 126 (FIGS. 3 and 12) or ON button 36 (FIGS. 1 and 12) to release the movable contact assemblies 100 for movement to their closed circuit position. As seen in FIGS. 3, 12 and 13, closing solenoid 126 includes a plunger 126*a* which carries at its outer end a pin 126*b*. Closing lever 114 carries a finger 114*a* positioned to engage pin 126*b* and pull closing solenoid plunger 126*a* out to its retracted position as the closing lever is released from its cocked position by latch lever 120 (FIG. 13). After the breaker operating mechanism has been charged, closing solenoid 126 may then be energized, and its plunger 126*a* is pulled in, causing closing lever 114 to be pivoted back to its cocked position. Hook 108 is consequently pivoted to its broken line position of FIG. 10, releasing the movable contact assemblies for closure.

For manual closing of the circuit breaker contacts, the ON button 36 is accommodated in a well 36*a* mounted by front wall 79 of covered assembly 26 at a location above a laterally turned flange portion 114*c* of an arm 114*d* carried by closing lever 114 (FIGS. 3, 12 and 13). It is thus seen that depression of ON button 36 against the bias of its return spring 36*b* engages flange portion 114*c* to pivot the closing lever back to its cocked position with the consequent release of the contact assemblies 100 for closure. From FIG. 3 it is seen that return of the closing lever to its cocked position, either by closing solenoid 126 or ON button 36, is sustained by latch lever 120 which is pivoted by its torsion spring 124 to bring latch shoulder 120*a* into engagement with the hook actuator lever.

Figure 14:
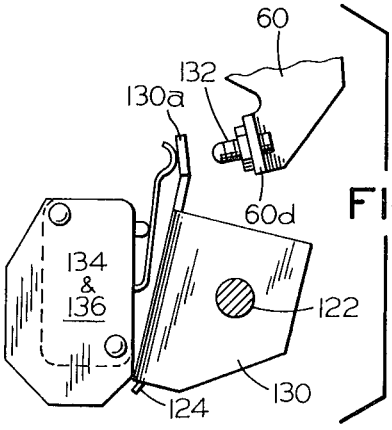
FIG. 14 is a fragmentary plan view illustrating the manner of actuation of certain switches seen in FIGS. 3 and 12 which are utilized in the electrical control of the operation of the power unit.

The pin 122, which mounts latch lever 120 as seen in FIGS. 3 and 12, also pivotally mounts a switch actuator 130 (FIG. 14). This switch actuator is normally biased in the clockwise direction by torsion spring 124. An arm 130*a* of this switch actuator is engaged by the end of a screw 132 adjustably threaded through an upwardly turned flange 60*d* carried by drive plate 60. Arm 130*a*, in turn, engages the actuators 134*a*, 136*a* of a pair of side-by-side switches 134, 136 (FIG. 12). While the drive plate is in its home position, the end of screw 132 engages arm 130*a* to pivot switch actuator 130 in the counter-clockwise direction against the bias of spring 124, such as to hold the respective actuators 134*a* and 136*a* of switches 134 and 136 depressed. Once drive plate 60 moves away from its home position during charging of the breaker operating mechanism by power unit 24, the end of screw 132 releases arm 130*a*, and switch actuator 130 is pivoted by its spring 124 in the clockwise direction, releasing the switch actuators. When drive plate 60 is returned to its home position at the conclusion of an operating mechanism charging cycle, the switch actuator 130 is re-engaged by the end of screw 132, and the actuators of switches 134 and 136 are again depressed. The functions of these switches will be described below in connection with the circuit diagram of the power unit control circuit.

To identify the condition of the circuit breaker 20, an indicator mechanism, generally indicated at 140 in FIG. 15, is provided. This indicator mechanism includes a display panel 142 having different display segments which are individually viewable through window 32 (FIG. 1) provided in the front wall of cover assembly housing. As seen in FIGS. 16 through 19, one display segment of the display panel bears the indicia "OFF" which, when viewable through window 32, identifies that the breaker contacts are in their open circuit conditions. A second display segment of display panel 142 bears the indicia "CHG" which, when viewable through window 32, identifies that the breaker operating mechanism is fully charged, but the breaker contacts are latched in their open circuit position by hook 108. The third display segment of panel 142 bears the indicia "ON" which, when viewable through window 32, identifies that the breaker contacts are closed.

Display panel 142 is carried by an indicator arm 144 pivotally mounted on a pin 146 which is supported by a depending portion 110*a* of bracket 110 (FIG. 12). Also pivotally mounted on pin 146 is a first control lever 148 and a second control lever 150. Control lever 148 is provided with a laterally turned tab 148*a*, while indicator arm 144 is provided with a laterally turned tab 144*a*; these tabs serving as anchor points for the ends of a tension spring 152. This spring serves to bias indicator arm 144 in a counterclockwise direction such that a second tab 144*b* turned from indicator arm 144 abuts control lever tab 148*a* while these elements are in their positions illustrated in FIGS. 15 and 16.

Figure 19:
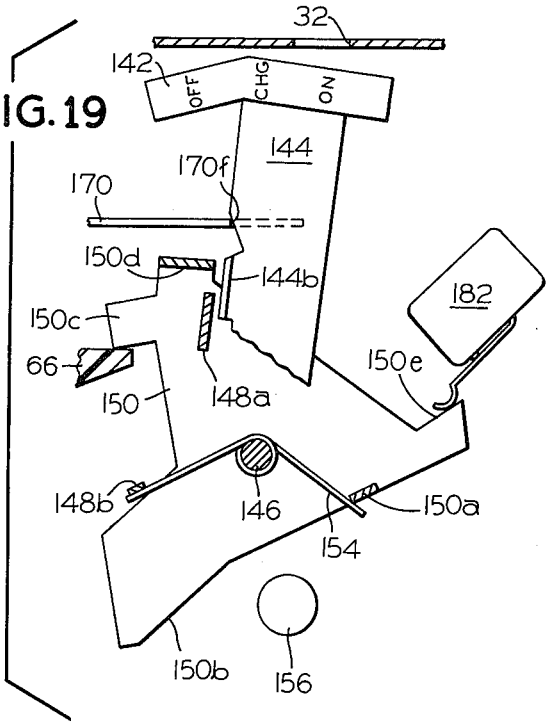

A torsion spring 154, mounted on pivot pin 146, has one end engaging a tab 148*b* struck from control lever 148 such that this control lever is biased in the clockwise direction with an edge portion 148*c* thereof abutting a stop 66*a* provided by the floor 66 of the power unit housing. The other end of torsion spring 154 acts against a laterally turned tab 150*a* carried by the second control lever 150, so as to bias this plate in the counterclockwise direction which, in the positions shown in FIGS. 15 and 16, brings an edge portion 150*b* of this plate into engagement with a pin 156 carried at the upper end of a lever 158. This latter lever is pivotally mounted on a shaft 160*a* on which is keyed a cradle 160 included as part of the breaker operating mechanism disclosed in the above identified co-pending application. The lower end of lever 158 is forked to provide a deep, bottom opening notch 158*a* in which is received the other end of pin 111 carried by one of the movable contact assemblies 100 (FIG. 10). Thus lever 158 is responsive to the position of the movable contact assemblies such that it assumed its solid line position shown in FIG. 15 when the contact assemblies are in their open circuit position and its broken line position when the contact assemblies are in their closed circuit position. With lever 158 at its solid line position, roller 156 at its upper end is in position to hold control lever 150 in its most clockwise position against the urgence of spring 154. On the other hand, when the contacts close, lever 158 is pivoted to its broken line position of FIG. 15, and control lever 150 is freed to move in the counterclockwise direction until a tab 150*c* extending from the upper corner of this lever engages the upper surface of stop 66*a*, as seen in FIG. 19.

Control lever 148 is acted upon by an arm 164 pinned to cradle shaft 160*a*. As seen from the above-noted co-pending application, as the breaker operating mechanism is being charged, the cradle is swung around from its tripped position, seen in solid line in FIG. 15, to a phantom position where it can be latchably engaged by a primary latch 166. Arm 164 follows this movement of cradle 160, and in so doing, engages a laterally turned tab 148*d* of control lever 148, pivoting this lever in the counterclockwise direction from its position shown in FIG. 15 to its position shown in FIG. 17. As long as cradle 160 is latchably engaged by primary latch 166, arm 164 holds control lever in its most counterclockwise position of FIG. 17.

From the description thus far it is seen that control lever 148 is responsive to the position of cradle 160 of the circuit breaker operating mechanism, while control lever 150 is responsive to the position of the movable contact assemblies 100. As will be seen from FIGS. 16 through 19, these control levers function in conjunction with a prop lever 170, best seen in FIG. 3, to control the angular position of indicator arm 144 such as to register the appropriate display segment of display panel 142 with window 32. Referring jointly to FIGS. 3 and 15, lever 170 is pivotally mounted on a pin 172 and is normally biased by a torsion spring 174 acting against a fixed stop 176 to bias the prop lever in the clockwise direction. Lever 170 is provided with an angularly turned free end portion 170*a* which projects into a position of engagement with the trailing edge 84*c* of upturned mounting flange 84*b* for plate 84. With plate 84 in its home position seen in FIG. 3, prop lever 170 is held by trailing edge 84*c* in its most counterclockwise position against the bias of spring 174. In this position, the lower left hand corner 170*b* of this lever is swung to the right in non-interfering relation with the portion of indicator arm 144 below its upper offset portion 144*c* to which display panel 142 is joined. However, during a charging operation, rotation of plate 84 with operating shaft 74 causes its trailing edge 84*c* to gradually release the prop lever as it progresses along an arcuate cam surface 170*c* of the prop lever. As a consequence, spring 174 ultimately moves prop lever 170 to its most clockwise position defined by pin 176 engaged in the enlarged opening 170*d* in the prop lever. In this most clockwise position, the corner 170*b* of prop lever is moved to the left into the path of counterclockwise movement of indicator arm 144.

Figure 18:
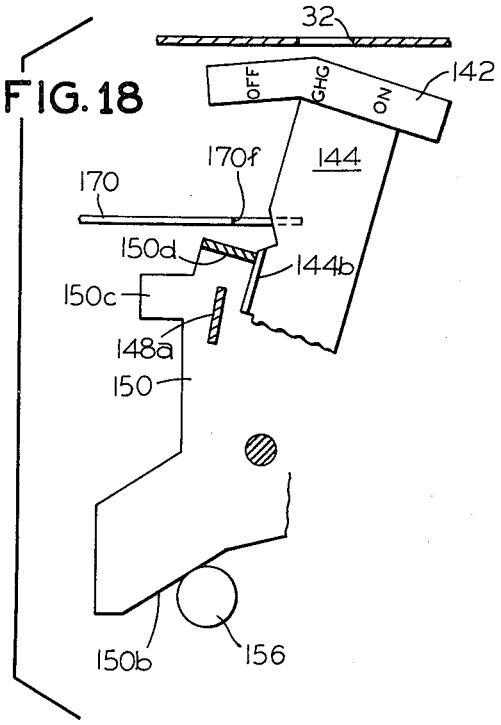

As cradle 160 is being reset to its latch position (phantom position in FIG. 15) during a charging cycle, arm 164 fast to the cradle shaft 160*a*, is swung in the clockwise direction into engagement with tab 148*d* of control lever 148. During the concluding resetting movement of the cradle, arm 164 pivots control plate 148 to its most counterclockwise position shown in FIG. 17. Spring 152 connected between control lever 148 and indicator arm 144 is tensioned such as to bias indicator arm 144 for counterclockwise rotation about its pivot pin 146. However, until the charging cycle is fully completed, prop lever 174 is in its most clockwise position, and thus its corner 170*b* obstructs movement of the indicator arm by tension spring 152. However, at the conclusion of the charging cycle, the trailing edge 84*c* of plate 84 is in its position seen in FIG. 3 to cam prop lever 170 back to its most counterclockwise position, clearing the corner 170*b* from obstructing the movement of indicator arm 144. Thus, as seen in FIG. 18, indicator arm 144 is free to move under the urgence of spring 152 to a position where its tab 144*b* engages a laterally turned tab 150*d* carried by control lever 150 which has yet to move. This limited pivotal movement of indicator arm 144 is effective to shift the display segment of display panel 142 bearing the indicia "CHG" into registry with window 32.

Upon disengagement of the hook 108 from contact assembly pin 111, either by closing solenoid 126 or depression of ON button 36, the movable contacts spring to their closed circuit position, and lever 158 is shifted to its broken line position seen in FIG. 15. Roller 156 carried by this lever is no longer in position to hold control lever 150 in its most clockwise position, and thus it is pivoted by its spring 154 to its most counterclockwise position seen in FIG. 18 with tab 150*c* engaging stop 66*a*. Indicator arm 144 is thus released for an additional increment of counterclockwise pivotal movement under the urgence of spring 152 until the edge of the indicator arm engages a shoulder 170*f* formed in prop lever 170 (FIG. 3). In this most counterclockwise angular orientation of the indicator arm, the display segment of display panel 142 bearing the indicia "ON" is registered with window 32.

It will be appreciated that upon tripping of the circuit breaker, cradle 160 abruptly swings around to its tripped position, carrying with it arm 164. Control lever 148 is thus released, and spring 154 pivots it around to its most clockwise position with edge 148*c* engaging stop 66*a*. During this clockwise movement of control lever 148, its tab 148*a* engages tab 144*b* to pick up the indicator arm for clockwise movement terminated by the engagement of its edge portion 144*d* with stop 66*a*. With the release of cradle 160, the breaker operating mechanism proceeds to open the breaker contacts. Lever 158 follows this opening movement in swinging to its solid line position seen in FIG. 15. The pin 156 carried at its upper end engages edge 150*b* to cam control lever 150 around in the clockwise direction to its solid line position seen in FIG. 15.

In addition to controlling the angular position of indicator arm 144, control levers 148 and 150 are provided with actuating tips 148*e* and 150*e*, respectively, which are effective to control the conditions of a pair of side-by-side switches 180 and 182 (see also FIG. 3). It is seen from FIG. 15, that while the control levers 148 and 150 are in their most clockwise positions assumed while the circuit breaker is in its OFF condition, their switch actuating tips 148*d* and 150*d* are in disengaging relation with their respective switches 180 and 182. When control lever 148 is shifted to its most counterclockwise position by arm 164, its tip 148*e* actuates switch 180 to signal to the power unit control circuit logic that cradle 160 is in its latched position. Similarly, when control lever 150 is shifted to its most counterclockwise position by spring 154 upon release by pin 156 carried by lever 158, its tip 150*e* actuates switch 182, signaling the power unit control circuit logic that the breaker contacts are closed.

A simplified schematic diagram of the power unit electrical control circuit is seen in FIG. 20. It will be appreciated that, in practice, the circuit will include additional electrical components to provide appropriate arc suppression, transient suppression and voltage flyback suppression. The control circuit is shown energized from a D.C. source however, in many installations, the control circuit will be energized from an A.C. source, and in this event, appropriate rectification is provided. Referring now to the circuit diagram, the positive side of the D.C. source is applied to terminal 200, while the negative side is applied to terminal 202. Terminal 200 is connected through the normally closed switches 86 and 182 the closed contacts 180*a*, 180*b* of switch 180 to terminal 204. A terminal 206 is connected through the operating coil 208 of a relay, generally indicated at 210, a resistor R1, and a Zener diode D1 to negative terminal 202. Terminals 204 and 206 are shunted by the normally open switch 136. Contact 180*c* of switch 180 is connected through the normally closed switch 134 to a terminal 212, while a terminal 214 is connected through the closing solenoid coil 126 to negative terminal 202. Terminals 200, 202, 204, 206, 212 and 214 are provided on terminal board 28 of FIG. 1. Positive supply terminal 200 is also connected to normally open contact 210*a* or relay 210. The movable contact 210*b* of this relay is connected to one side of the permanent magnet D.C. motor 40, while the other side of this motor is connected to the negative supply terminal 202. Relay contact 210*b* normally engages relay contact 210*c* which is connected through a braking resistor R2 to the other side of motor 40.

The operation of the electrical control circuit of FIG. 20 will now be described. To initiate a charging function by motor 40, terminals 204 and 206 are shorted together, as functionally indicated at 205. It is seen that current can thus flow through the normally closed switches 182 and 86, the closed contacts 180*a* and 180*b* of switch 180, relay coil 208, resistor R1 and Zener diode D1 to the negative supply terminal 202. Resistors R1 and Zener diode D1 are selected so as to provide the desired pickup and drop out characteristics for relay 210. Energization of relay coil 208 causes its movable contact 210*b* to break with contact 210*c* and make with contact 210*a.* As a result, a D.C. energization circuit for motor 40 is completed between terminals 200 and 202. Referring to FIG. 3, motor 40 begins charging the breaker operating mechanism by rotating drive plate 60 which is coupled to operating shaft 74. As the drive plate moves away from its home position in the counterclockwise direction, the end of adjusting screw 132 releases switch actuator lever 130 which, in turn, releases switches 134 and 136. Referring back to the wiring diagram, it is seen that switch 136 closes to provide a current path shunting terminals 204 and 206. Thus, the short 205 applied to initiate a charging function can be removed, as the now closed switch 136 seals in the energization circuit for relay coil 208. This continued energization of the relay coil seals in its contacts 210*a* and 210*b* to insure continued energization of the motor 40 for the complete charging cycle.

Upon completion of 120° of counterclockwise rotation of drive plate 60, operating shaft 74 will have been driven through a like increment of counterclockwise rotation. Slide 72 will have thus completed its forward stroke and cradle 160 will have arrived at its position of latching engagement with primary latch 166. As a consequence, arm 164, keyed to cradle shaft 160*a,* will have been rotated in the clockwise direction as seen in FIG. 15 to pivot control lever 148 in the clockwise direction such that its tip 148*e* actuates switch 180. Referring back to the wiring diagram, it is seen that upon actuating of switch 180, its contact 180*a* is shifted from engagement with contact 180*b* to engagement with contact 180*c.* Upon the arrival of drive plate 60 back to its home position to complete the charging cycle, the end of adjusting screw re-engages switch actuator 130 which, in turn, re-engages switches 134 and 136. Switch 134 thus returns to its normally closed condition, while switch 136 is returned to its normally open position breaking the energization circuit for relay coil 208. As this relay drops out, its movable contact 210*b* disengages from contact 210*a* and engages its contact 210*c* to connect the braking resistor R2 in shunt with motor 40. The energization circuit for the motor is broken and the braking resistor is effective to abruptly brake the motor to a stop, leaving the drive plate 60 precisely in its home position. Rotation of the adjusting screw 132 provides for fine adjustment of the angular orientation of the drive plate home position.

At the conclusion of the charging cycle, it is seen from the wiring diagram that switches 86 and 182 remain closed, while switch 134 is reclosed and switch 136 is re-opened. Switch 180 has assumed its condition wherein movable contact 180*a* is engaging contact 180*c.* These switch conditions serve to prevent a re-initiation of the charging cycle, a needless act since the mechanism is already charged, and to arm the energization circuit for closing solenoid 126.

To close the breaker contacts by energization of the closing solenoid, terminals 212 and 214 are shorted together, as functionally indicated at 213, to connect the closing solenoid coil 126 directly across the D.C. supply terminals 200, 202. Hook 108 is disengaged from the contact carrier assembly, and the breaker contacts close (FIG. 10). Movement of lever 158 to its broken line position seen in FIG. 15, causes pin 156 to release control lever 150. This control lever is thus freed for counterclockwise rotation by its spring 154 bringing its tip 150*e* into actuating engagement with switch 182. Switch 182 opens to disable the control circuit from accommodating either a charging function or a contact closing function. The circuit is then completely inoperative until such time as the breaker contacts are reopened.

The normally closed switch 86 in the control circuit functions, as previously noted, as an interlock to completely disable the control circuit in the event the operating mechanism is being charged manually. As seen from FIGS. 7 and 8, when button 31 is depressed to shift operating shaft 74 downward and couple the rotary handle 30 to the operating shaft, plate 84 releases switch 86 which opens to prevent inadvertent energization of motor 40. Once a manual charging cycle is completed, compression spring 78 returns operating shaft 74 to its elevated position, and plate 84 re-actuates switch 86 to its closed condition. Consequently, even though the circuit breaker operating mechanism was manually charged, the control circuit of FIG. 20 will accommodate closure of the circuit breaker via energization of closing solenoid 126. Alternatively, closure of the breaker contacts can be effected by manual depression of ON button 36.

As an additional feature of the present invention, switch 182 is also utilized to serve an anti-pumping function. If for some reason, the breaker latch 166 is held in its non-latching position, such as by a breaker lockout accessory, the initiation of a charging cycle is useless since the cradle will simply return to its unlatched position at the conclusion of the charging cycle. In certain automated system applications, failure of the cradle to be latched at the conclusion of a charging cycle will simply signal a re-initiation of another charging cycle. To prevent this needless pumping of the breaker operating mechanism, a lever 220 is mounted on a pin 222 with one end 220*a* situated to engage switch 182, as seen in FIG. 21. The other end 220*b* of this lever also seen in FIG. 3, is disposed to engage a tandem OFF button 223 which is reciprocatingly mounted by the power unit housing floor 66 in registry under the OFF button 34 reciprocatingly mounted by the cover assembly front wall 79. Thus, manual depression of button 34 causes its depending stem 34*a* to depress button 223, whose lower end engages and pivots latch 166 to its non-latching position. A light spring 224 biases the lever in the clockwise direction, such that the lever end 220*b* biases tandem OFF button 223 downward to sustain its engagement with latch 166. Thus lever 220 senses the vertical position of button 223 which is indicative of the position of latch 166. If the breaker latch is held in its non-latching position, tandem OFF button 223 will assume a depressed position under the bias of lever spring 224 independently of OFF button 34. Lever 220 will, in sensing this depressed position of button 223, assume its most clockwise position, bringing its end 220*a* into actuating engagement with switch 182. This switch thus opens to inhibit initiation of a charging cycle, as seen in FIG. 20. It is thus seen that as long as the breaker latch is held in its non-latching position, switch 182 is engaged and held in its open position, thereby accomplishing its anti-pumping function. It is understood that when the breaker latch 166 is released, its spring (not shown) overpowers lever spring 224 in returning the latch to its latching position. Lever 220 is returned to its most counterclockwise position and switch 182 is released for closure to enable a charging cycle.

Referring jointly to FIGS. 3 and 12, a safety interlock lever 230 is pivotally mounted intermediate its ends by a pin 232 supported by bracket 110 (FIG. 12). A strong spring 234 normally biases this lever such that its end 230*a* engages and depresses tandem OFF button 223 (FIG. 3), thereby tripping the breaker if it is closed and holding the breaker latch in its non-latching position to prevent subsequent reclosure of the breaker. The other end 230*b* of this lever is engaged and depressed by the cover assembly housing, when in place, to hold the lever end 230*a* in disengaged relation with tandem OFF button 223. This button may then assume its elevated position, thus removing its disablement breaker latch 166. It is thus seen that as long as the cover assembly 26 is in place, circuit breaker 20 can be operated in normal fashion via the handle 30 or the power unit 24. However, upon removal of the cover assembly 26, lever 230 is released and its spring pivots this lever into depressing engagement with the tandem OFF button 223 to automatically trip the breaker if the breaker is still in its ON condition. Continued depression of button 223 by lever 230 as long as the cover assembly is displaced, prevents operation of the breaker.

It will thus be seen that the objects set forth above, among those made apparent in the preceding description, are efficiently attained and, since certain changes may be made in the above construction without departing from the scope of the invention, it is intended that all matter contained in the above description or shown in the accompanying drawings shall be interpreted as illustrative and not in a limiting sense.

Having described our invention, what we claim as new and desire to secure by Letters Patent is:

1. In a circuit breaker having a spring powered operating mechanism for articulating movable contacts between open and closed circuit positions with respect to stationary contacts, apparatus for charging the breaker operating mechanism and then releasing the energy stored therein pursuant to forcibly closing the breaker contacts, said apparatus comprising, in combination:

A. an electric motor;
B. a first drive element;
C. first means drivingly connecting said motor to said first drive element;
D. a second drive element drivingly connected to the breaker operating mechanism;
E. second means selectively drivingly interconnecting said first and second drive elements to accommodate a motor-driven breaker operating mechanism charging cycle;
F. a first control element responsive to the breaker operating mechanism for sensing its charged and discharged conditions;
G. a second control element responsive to the breaker movable contacts for sensing their open and closed circuit positions;
H. a third control element responsive to said second means for sensing a charging cycle in progress;
I. a closing mechanism including
   1. a hook releasably latching engaging the breaker movable contacts to retain the contacts in their open circuit position during a charging cycle, and
   2. means actuating said hook to release the breaker movable contacts for closure upon completion of a charging cycle; and
J. indicator means controllably positioned by said first, second and third control elements to variably display indicia identifying various breaker conditions produced by the apparatus.

2. The apparatus defined in claim 1, wherein said first and second drive elements are respectively first and second rotatably mounted drive plates, and said first connecting means includes 1. a reduction gear box having an input shaft coupled to said motor, and an output shaft,
2. a crank fixed to said output shaft, and
3. a rigid link pivotally connected at one end to said crank and pivotally connected at its other end eccentrically to said first drive plate,
4. whereby each full rotation of said output shaft oscillates said first drive plate through an angle less than 180°, each oscillation of said first drive plate corresponding to a charging cycle.

3. The apparatus defined in claim 1, wherein said second means includes 1. a rotatably mounted hub, said first drive element mounted by said hub for rotation relative thereto, and said second drive element affixed to said hub for rotation therewith, and
2. a coupling element mounted for movement between a first position drivingly coupling said first drive element to said hub and a second position decoupling said first drive element from said hub.

4. The apparatus defined in claim 3, which further includes a manual rotary operating handle, and said second means further includes 1. a third drive element affixed to said handle,
2. a shaft mounted concentrically by said hub for axial movement relative thereto,
3. said coupling element mounted by said shaft, and drivingly interconnecting said shaft and hub,
4. an actuator manually operable to shift said shaft from a first axial position where said coupling element assumes its first position to a second axial position where said coupling element assumed its second position, said shaft while in its second axial position, being drivingly connected with said third drive element to accommodate a manual charging cycle via said handle.

5. The apparatus defined in claim 4, wherein said second means further includes a spring incorporated in said hub for normally biasing said shaft to its first axial position in decoupled relation to said third drive element.

6. The apparatus defined in claim 5, wherein said hub includes diametrically opposed notches, said coupling element includes first and second opposed tabs extending axially of said shaft and respectively accommodated in said hub notches to rotatably interconnect said hub and coupling element, said first drive plate including a slot and a shoulder, said first tab engaged in said slot and said second tab engaged by said shoulder with said coupling element in its first position to couple rotation of said first drive element by said motor to said hub, said first tab disengaged from said slot with said coupling element in its second position to decouple said first drive element from said hub.

7. The apparatus defined in claim 6, wherein said second tab is longer than said first tab, whereby, with said coupling element in its second position, said second tab moves relative to said shoulder during a manual charging cycle and engages said shoulder at the conclusion of a manual charging cycle to establish a home position for said shaft and coupling element.

8. The apparatus defined in claim 1, wherein said indicator means includes 1 a display panel having plural, distinct display indicia thereon, and 2. a pivotally mounted indicator arm supporting said display panel for movement between first, second and third distinct display positions to register selected ones of said indicia with a window.

9. The apparatus defined in claim 8, wherein 1. said first control element being independently pivotally mounted for movement from a first position to a second position in response to charging of the breaker operating mechanism,
2. said second control element being independently pivotally mounted for movement from a first position to a second position in response to closure of the breaker contacts,
3. said third control element being independently pivotally mounted for movement from a first position to a second position in response to a charging cycle in progress and automatically returning to its first position at the conclusion of a charging cycle,
4. said control elements establishing plural stops for arresting the pivotal movement of said indicator arm such as to position said display panel at its first, second and third display positions.

10. The apparatus defined in claim 9, wherein said indicator means further includes 1. a first stop carried by said first control element, with said first control element in its first position, said first stop engaging said indicator arm to position said display position,
2. a spring interconnecting said first control element and said indicator arm, with said first control element in its second position, said spring biasing said arm for movement in a direction to bring said display panel to its second display position and ultimately to its third display position,
3. a second stop carried by said third control element, with said third control element in its second position, said second stop engaging said indicator arm to inhibit movement thereof under the bias of said spring and thereby sustain said display panel in its first display position, said second stop disengaging said indicator arm with said third control element in its first position to free said display panel for movement away from its first display position,
4. a third stop carried by said second control element, said third stop engaging said indicator arm with said second control lever in its first position to stop said display panel in its second display position, said third stop disengaging said indicator arm with said second control element in its second position to enable movement of said display panel under the bias of said spring to its third display position.

11. The apparatus defined in claim 10, wherein said indicator means further includes a second spring acting on said first control element to return it from its second position to its first position upon tripping of the circuit breaker operating mechanism and consequent opening of the breaker contacts, said first stop carried by said first control element engaging said indicator arm to move said display panel from its third display position back to its first display position as said first control element is returned from its second position to its first position by said second spring.

12. The apparatus defined in claim 9, wherein said hook actuating means is a closing solenoid.

13. The apparatus defined in claim 12, which further includes a latch acting in response to initiation of a charging cycle, to release said hook for movement into latching engagement with the breaker movable contacts, energization of said solenoid after completion of a charging cycle moving said hook away from latching engagement with the breaker movable contacts, releasing the breaker contacts for closure.

14. The apparatus defined in claim 13, which further includes a control circuit having energizing current paths for said motor and said closing solenoid, and switch means in said control circuit positioned for selective activation by said first and second control elements to appropriately enable and disable said energizing current paths for said motor and said solenoid.

15. The apparatus defined in claim 14, which further includes additional switch means in said control circuit, said additional switch means activated in response to movement of said first drive element during a motor charging cycle to further selectively enable and disable said motor and closing solenoid energizing current paths.

16. The apparatus defined in claim 1, wherein said motor is a permanent magnet DC motor.

17. In a circuit breaker having a spring powered operating mechanism for articulating movable contacts between open and closed circuit positions with respect to stationary contacts, apparatus for charging the breaker operating mechanism and then releasing the energy stored therein pursuant to forcibly closing the breaker contacts, said apparatus comprising, in combination:

A. an electric motor;

B. a first drive element drivingly coupled to said motor;

C. a second drive element drivingly connected to the breaker operating mechanism;

D. means selectively drivingly interconnecting said first and second drive elements for motor-driven breaker operating mechanism charging cycle;

E. A first control element responsive to the breaker operating mechanism for sensing its charged and discharged conditions;

F. a second control element responsive to the breaker movable contacts for sensing their open and closed circuit positions;

G. a closing mechanism including 1. a hook releasably, latchably engaging the breaker movable contacts to retain them in their open circuit position during a charging cycle; and
2. a solenoid actuating said hook to release the breaker movable contacts for closure upon completion of a charging cycle; and H. a control circuit including 1. a first current path for energization of said motor;
2. a second current path for energization of said solenoid;
3. switch means responsive to movement of said first drive element for enabling said first current path and disabling said second current path during a charging cycle;
4. a first switch responsive to said first control element for enabling said first current path while said breaker mechanism is uncharged, and, once charged, to disable said first current path and enable said second current path, and
5. a second switch responsive to said second control element for enabling said first and second current paths while the breaker movable contacts are in their open circuit position and disabling said first and second current paths while said breaker movable contacts are in their closed circuit position.

18. The apparatus defined in claim 17, wherein said motor is a DC permanent magnet motor, and said control circuit further including 1. a braking resistor, and
2. a relay having an operating coil for actuating relay contacts between a first position completing said first current path and a second position interrupting said first current path while connecting said braking resistor in shunt with said motor;
3. said switching means and said first and second switches operating to control the energization of said relay coil, such that said relay contacts assume said first position for the duration of a charging cycle and assume said second position upon completion of a charging cycle.

19. The apparatus defined in claim 18, wherein said control circuit further includes a Zener diode and a resistor connected in series with said relay coil for establishing the pickup and drop out characteristics of said relay.

20. The apparatus defined in claim 18, wherein the circuit breaker includes a manual operating handle, and said interconnecting means is operable to disconnect said first drive element from said second drive element and drivingly connect said handle to said second drive element to accommodate a manual breaker operating mechanism charging cycle.

21. The apparatus defined in claim 20, wherein said control circuit includes an interlock switch responsive to said interconnecting means for disabling said first current path while the handle is drivingly connected to said second drive element.

22. The apparatus defined in claim 17, which further includes anti-pumping means responsive to the breaker operating mechanism for controlling said second switch to disable said first and second current paths while the breaker operating mechanism is incapable of holding a charge.

23. The apparatus defined in claim 18, wherein said switching means includes 1. a third switch connected in the relay coil energization circuit, said third switch closing to sustain relay coil energization during a charging cycle and opening automatically upon conclusion of a charging cycle to terminate relay coil energization, and
2. a fourth switch connected in said second current path, said fourth switch opening for the duration of a charging cycle and closing automatically upon conclusion of a charging cycle to enable said second current path.

24. The apparatus defined in claim 23, wherein said control circuit includes 1. a pair of first terminals connected in said relay coil energization circuit, said first terminals shorted together to complete said relay coil energization circuit through said first and second switches, thereby initiating a charging cycle,
2. said third switch connected in shunt with said first terminals and said first switch to complete an alternative relay coil energization circuit for the duration of a charging cycle, and
3. a pair of second terminals connected in said second current path, said second terminals being shorted together to complete a solenoid energization circuit through said first, second and fourth switches.

25. The apparatus defined in claim 17, which further includes a third control element responsive to said interconnecting means for sensing a charging cycle in progress; and indicator means controllably positioned by said first, second and third control elements to variably display indicia identifying various breaker conditions produced by the apparatus.

26. The apparatus defined in claim 25, wherein said indicator means includes a pivotally mounted indicator movable between first, second and third display positions to display different breaker condition identifying indicia in a window.

27. The apparatus defined in claim 26, wherein 1. said first control element being independently pivotally mounted for movement from a first position to a second position in response to charging of the breaker operating mechanism.
2. said second control element being independently pivotally mounted for movement from a first position to a second position in response to closure of the breaker contacts,
3. said third control element being independently pivotally mounted for movement from a first position to a second position in response to a charging cycle in progress and automatically returning to its first position at the conclusion of a charging cycle.
4. said control elements establishing plural stops for arresting the pivotal movement of said indicator so as to controllably position it in its first, second and third display positions.

* * * * *